US006997854B2

(12) United States Patent
Yang

(10) Patent No.: US 6,997,854 B2
(45) Date of Patent: Feb. 14, 2006

(54) TRAVEL ADJUSTING DEVICE FOR STEPPING EXERCISERS

(76) Inventor: Zhong-Jin Yang, No. 76 Lane 171, Sec. 1 Shen Lin Rd., Da Ya Hsiang, Taichung Hsien (TW)

( * ) Notice: Subject to any disclaimer, the term of this patent is extended or adjusted under 35 U.S.C. 154(b) by 2 days.

(21) Appl. No.: 10/895,205

(22) Filed: Jul. 19, 2004

(65) Prior Publication Data

US 2006/0014612 A1 Jan. 19, 2006

(51) Int. Cl.
*A63B 22/04* (2006.01)

(52) U.S. Cl. ..... 482/53

(58) Field of Classification Search ..... 482/51–53, 482/79–80, 148, 908, 111–113
See application file for complete search history.

(56) References Cited

U.S. PATENT DOCUMENTS

| | | | | |
|---|---|---|---|---|
| 5,232,421 | A * | 8/1993 | Chen et al. | 482/53 |
| 5,676,623 | A * | 10/1997 | Yu | 482/53 |
| 6,224,515 | B1 * | 5/2001 | Chen | 482/53 |
| 6,709,367 | B1 * | 3/2004 | Liang | 482/53 |
| 6,712,739 | B1 * | 3/2004 | Chen | 482/53 |

* cited by examiner

*Primary Examiner*—Stephen R. Crow
(74) *Attorney, Agent, or Firm*—Charles E. Baxley

(57) ABSTRACT

An adjusting device of stepping exercisers is movably connected to slots in a base on a frame and a flexible member is connected to the adjusting device. Two ends of the flexible member are respectively connected to two links of the two pedals. When the adjusting device is adjusted to a higher position, the two pedals are positioned at higher positions, and are positioned at lower positions when the adjusting device is lowered.

7 Claims, 5 Drawing Sheets

TRAVEL ADJUSTING DEVICE FOR STEPPING EXERCISERS

FIELD OF THE INVENTION

The present invention relates to a stepping exerciser wherein the travel of the pedals can be adjusted.

BACKGROUND OF THE INVENTION

A conventional stepping exerciser generally includes a frame with a post and a handlebar connected on the post. Two pedals each are connected with a cylinder so as to provide a resistance and the user steps on the two pedals and pushes the two pedals alternatively to overcome the resistance from the cylinders. Nevertheless, the upper most position and the lower most position are not able to be adjusted, in other words, for different users, some want to have a lower upper most position of the pedals and some want to have a higher upper most position of the pedals, the conventional stepping exercisers cannot provide such adjustable feature.

The present invention intends to provide a stepping exerciser that includes an adjusting device for adjusting the positions of the pedals.

SUMMARY OF THE INVENTION

The present invention relates to a stepping exerciser that comprises a frame includes a base extending therefrom and two slots defined through two walls of the base. A post with a handlebar is connected to the frame. Two pedals are respectively pivotably connected to the base and an adjusting device is connected to the base and movably secured to the two slots. A flexible member is connected to the adjusting device and two ends of the flexible member are connected to the two pedals.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
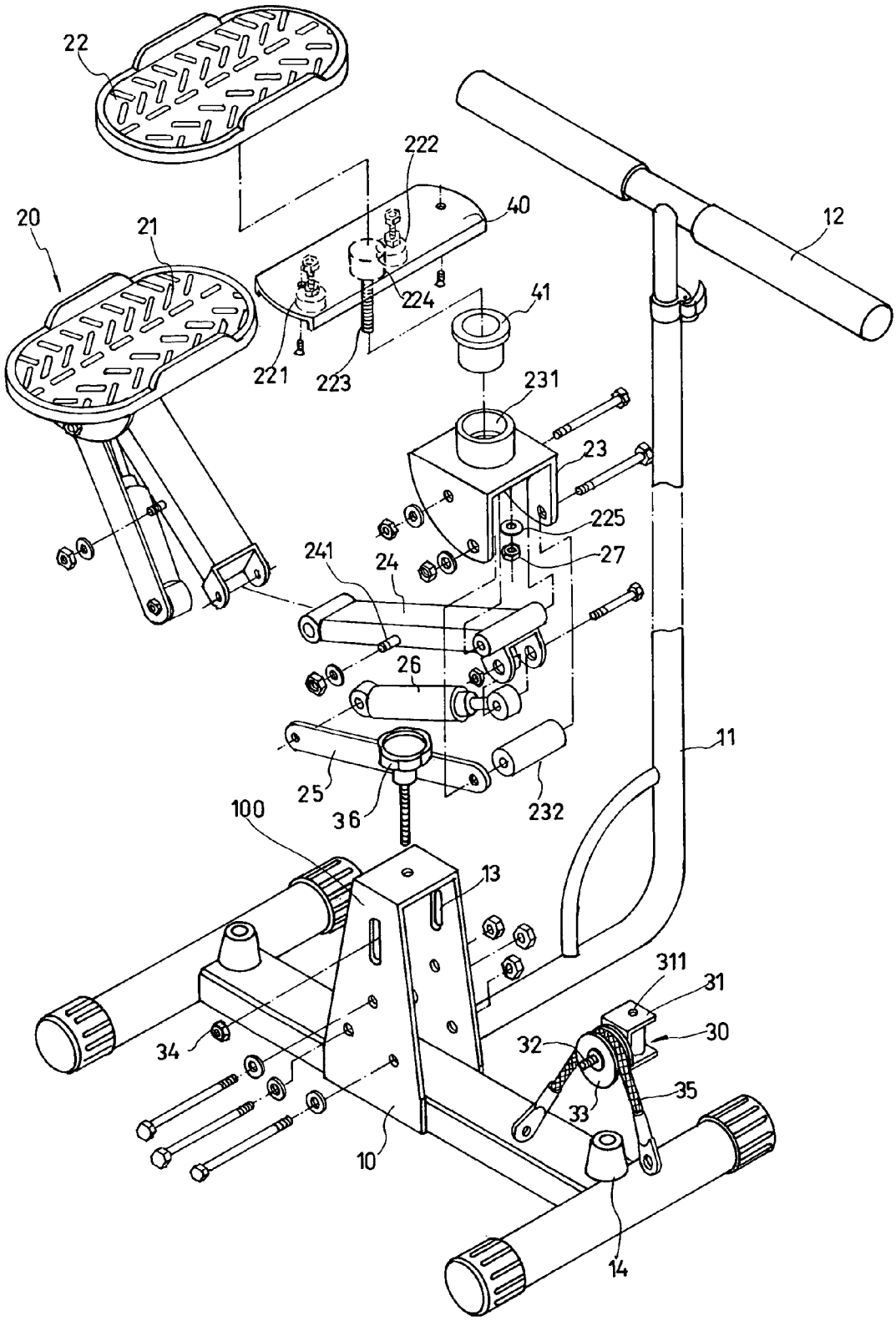
FIG. 1 is an exploded view to show the stepping exerciser of the present invention.
Figure 2:
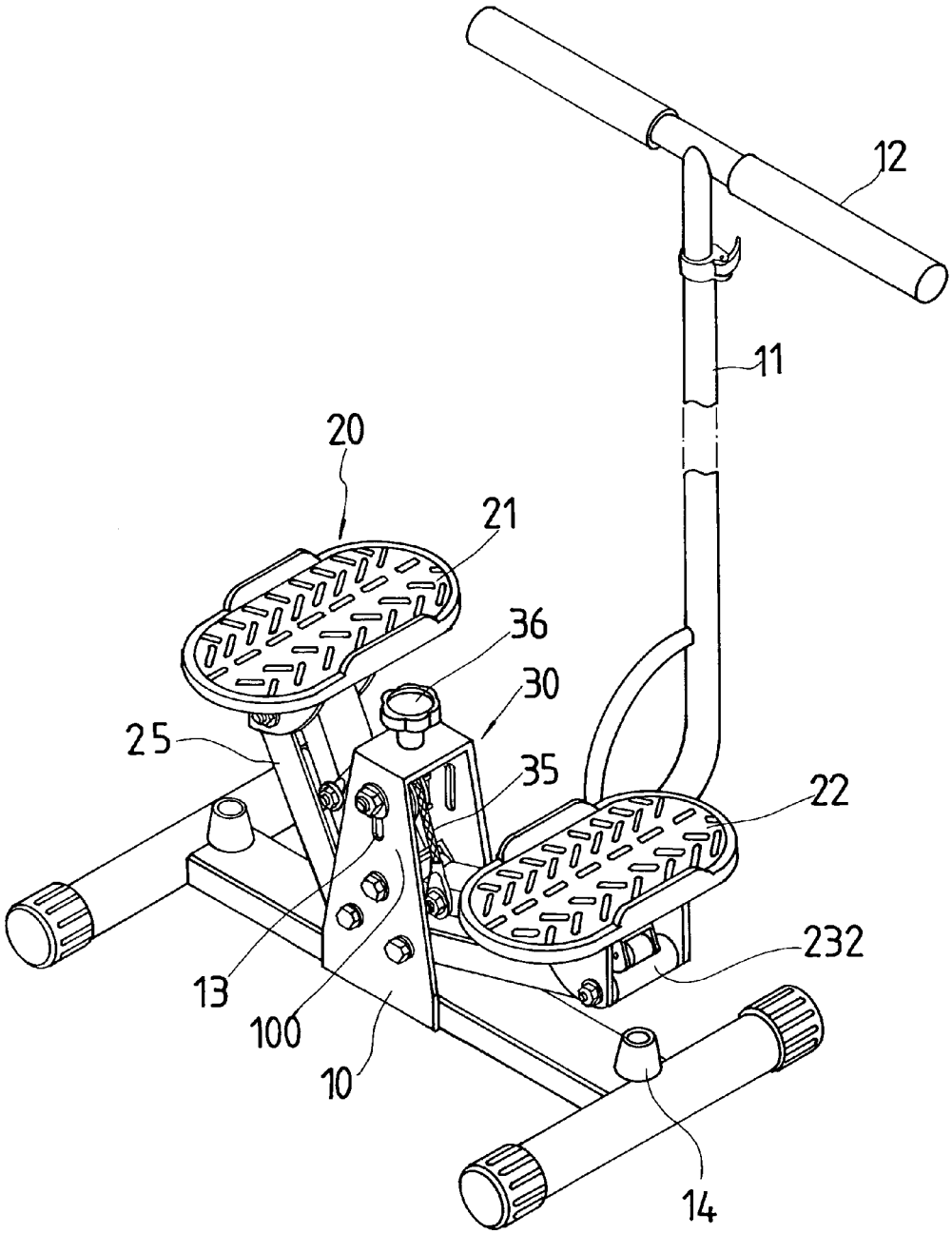
FIG. 2 is a perspective view to show the stepping exerciser of the present invention.
Figure 4:
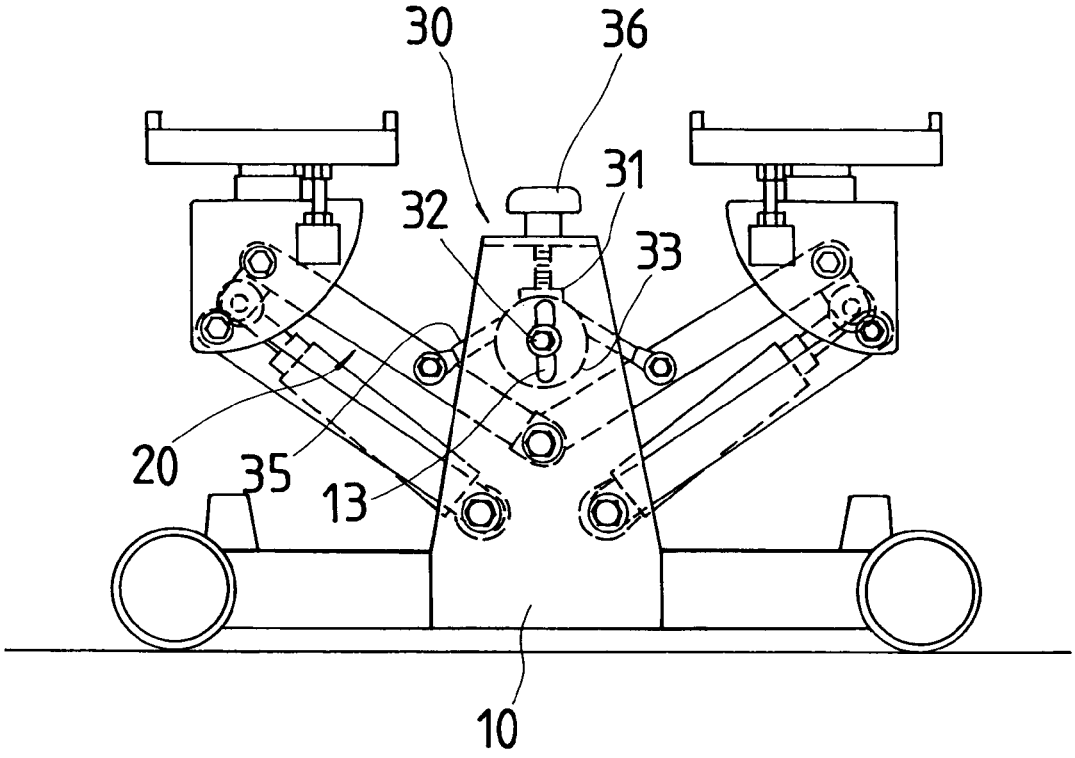
FIG. 4 shows the pedals are located at lower positions when the adjusting device is moved to a lower position.

Referring to FIGS. 1, 2 and 4, the stepping exerciser of the present invention comprises an H-shaped frame 10 includes a base 100 extending therefrom and two slots 13 are defined through two opposite walls of the base 100. A post 11 is connected to the frame 10 and a handlebar 12 is connected to a top of the post 11. The post 11 can be a retractable post as known in the art.

Figure 3:
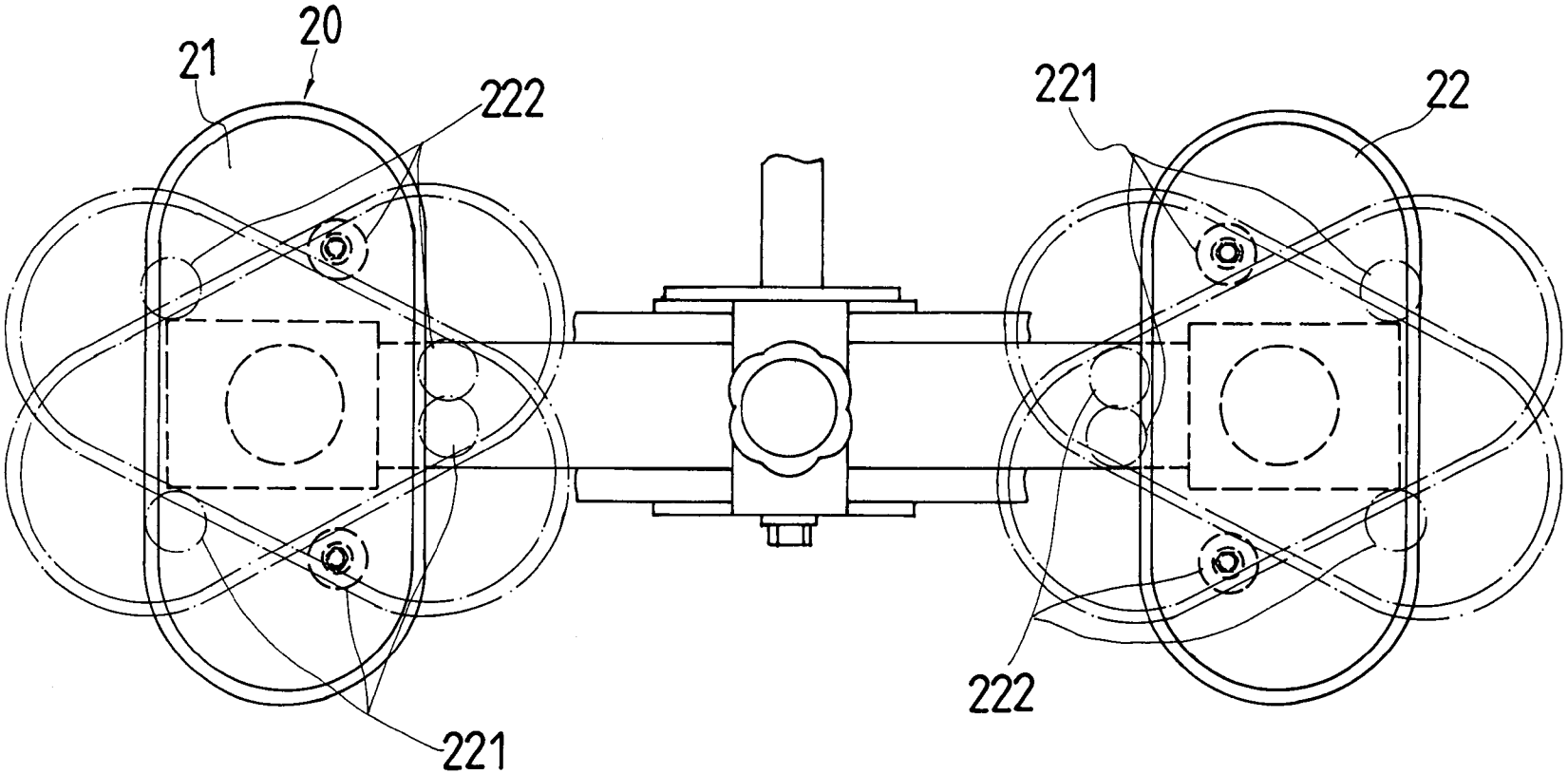
FIG. 3 is a top view to show the rotation of the pedals.

A pedal system 20 includes two pedals 21, 22 respectively connected to two bottom boards 40. Each of the two bottom boards 40 includes two stop members 221, 222 extending from an underside thereof and a connection bolt 223 connected to a block member 224. The two bottom boards 40 are rotatably connected to two support frames 23 wherein each support frame 23 includes a neck 231 extending from a top thereof and a durable sleeve 41 is rotatably inserted in the neck 231. The connection bolts 223 are respectively inserted through the sleeves 41 and are connected to a washer 225 and a nut 27. By this way, the angle that the pedals 21, 22 rotate relative to the support frames 23 can be set when the two stop members 221, 222 contact the support frames 23 as shown in FIG. 3.

Two respective ends of two links 24 are respectively connected to the two support frames 23 and the other ends of the two links 24 are co-axially connected to the base 100. Two cylinders 26 and two plates 25 are respectively connected between the base 100 and the two pedals 21, 22. The two cylinders 26 provide resistance when the user tries to step down the pedals 21, 22.

An adjusting device 30 is connected to the base 100 and includes a U-shaped frame 31 and a pulley 33 connected to the U-shaped frame 31. A flexible member 35 such as a steel cable is engaged with through the pulley 33 and two ends of the flexible member 35 are respectively connected to two respective protrusions 241 extending from a side of the two links 24 of the two pedals 21, 22. A position bolt 32 extends through the slots 13 and the adjusting device 30 and is connected to a nut 34. An adjusting bolt 36 extends through a hole 311 in a top of the base 100 and is connected to the U-shaped frame 31.

Figure 5:
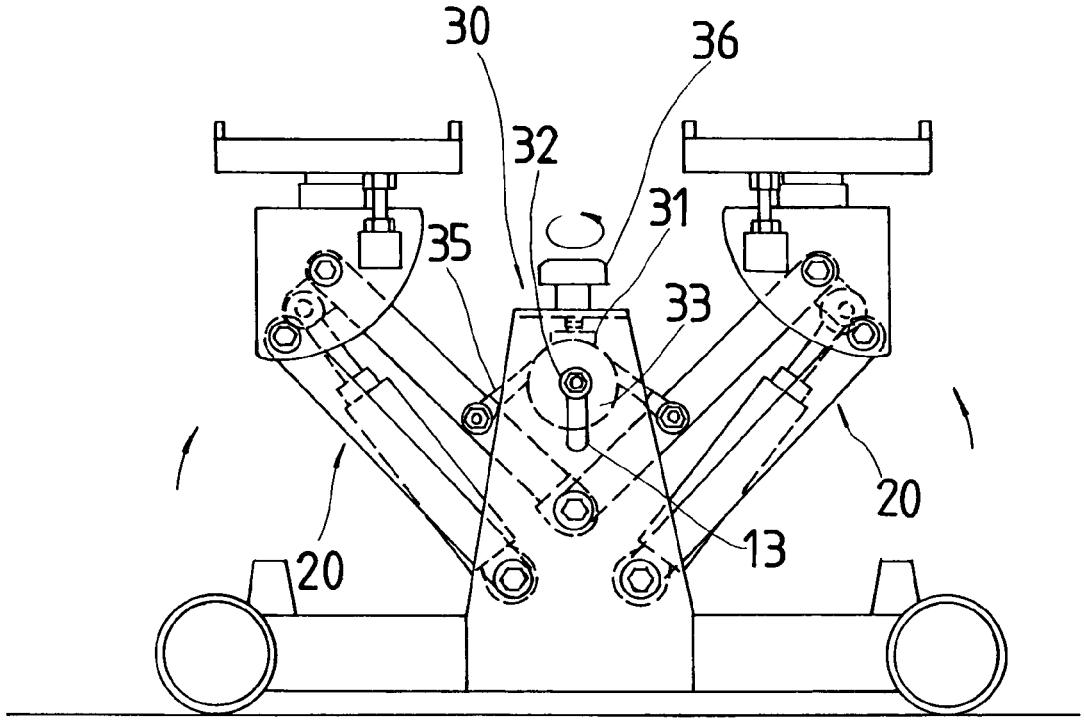
FIG. 5 shows the pedals are located at higher positions when the adjusting device is moved to a higher position.

As shown in FIGS. 4 and 5, the adjusting device 30 can be set at a lower position as shown in FIG. 4 or a higher position as shown in FIG. 5, and the adjusting device 30 is then able to be moved in the two slots 13. That is to say, the pedals 21, 22 are located at lower positions when the adjusting device 30 is moved to the lower position and the pedals 21, 22 are located at higher positions when the adjusting device 30 is moved to the higher position. Two rubber members 14 are connected on the frame 10 such that there will be no noise when the pedals 21, 22 are pushed to their lowest positions.

While we have shown and described the embodiment in accordance with the present invention, it should be clear to those skilled in the art that further embodiments may be made without departing from the scope of the present invention.

What is claimed is:

1. A stepping exerciser comprising:

a frame includes a base extending therefrom and two slots defined through two walls of the base, a post connected to the frame and a handlebar connected to a top of the post;

two pedals respectively pivotably connected to the base, and an adjusting device connected to the base and movably secured to the two slots, a flexible member connected to the adjusting device and two ends of the flexible member connected to the two pedals said adjusting device includes a U-shaped frame, a pulley connected to the U-shaped frame, the flexible member engaged with said pulley, a position bolt extending through the slots and the adjusting device and secured to a nut; and an adjusting bolt which extends through a top of the base and is connected to the U-shaped frame.

2. The exerciser as claimed in claim 1, wherein the flexible member is a steel cable.

3. The exerciser as claimed in claim 1, wherein the two pedals are connected to two links respectively and the two respective links co-axially connected to the base and two cylinders respectively connected between the base and the two pedals.

4. The exerciser as claimed in claim 3, wherein the two links each have a protrusion extending from a side thereof and the two ends of the flexible member are connected to the two protrusions respectively.

5. The exerciser as claimed in claim 3, wherein two support frames are respectively connected to the two pedals and the two links and cylinders are pivotably connected to the two support frames.

6. The exerciser as claimed in claim 5, wherein two bottom boards are rotatably connected to the two support frames and the two pedals are fixed on the two bottom boards.

7. The exerciser as claimed in claim 6, wherein each of the two bottom boards includes two stop members extending from an underside thereof so as to limit the angle that the pedals rotate relative to the support frames when the two stop members contact the support frames.

* * * * *